US005192194A

United States Patent [19]

Birdwell

[11] Patent Number: 5,192,194

[45] Date of Patent: Mar. 9, 1993

[54] EXPLOSION PROOF COMPRESSOR AND A METHOD FOR EXPLOSION PROOFING A COMPRESSOR

[75] Inventor: Gaylon W. Birdwell, Houston, Tex.

[73] Assignee: Air Engineers, Inc., Houston, Tex.

[21] Appl. No.: 690,045

[22] Filed: Apr. 23, 1991

[51] Int. Cl.[5] ..... F04B 49/02

[52] U.S. Cl. ..... 417/9; 417/44; 417/53; 310/88

[58] Field of Search ..... 417/9, 44, 53; 310/88

[56] References Cited

U.S. PATENT DOCUMENTS

| | | | |
|---|---|---|---|
| 3,003,683 | 10/1961 | Manning et al. | 310/88 |
| 3,527,909 | 9/1970 | Torre | 200/83 |
| 4,065,653 | 12/1977 | Jones | 200/302 |
| 4,205,246 | 5/1980 | Wise et al. | 310/68 |
| 4,732,526 | 3/1988 | Nakashima et al. | 310/88 |
| 4,802,502 | 1/1989 | Williams | 137/382 |
| 4,894,497 | 1/1990 | Lycan | 200/83 |
| 4,964,788 | 10/1990 | Itameri-Kinter et al. | 417/422 |
| 4,984,745 | 1/1991 | Akeel et al. | 310/88 |

OTHER PUBLICATIONS

"NFPA 496: Purged and Pressurized Enclosures For Electrical Equipment"; 1989 Edition; National Fire Protection Association.

*Primary Examiner*—Richard A. Bertsch
*Assistant Examiner*—David W. Scheuermann

[57] ABSTRACT

An explosion proof compressor and method for explosion proofing a compressor for use with air conditioning or refrigeration system in a hazardous location where flammable gases or vapors may exist places the electrical supply terminals for the compressor within a gas tight housing which is pressurized with low pressure refrigerant gas being compressed by the compressor. The gas tight housing is in a fluid-transmitting relationship with a pressure responsive switch, whereby upon a pre-selected decrease in the pressure within the gas tight housing, the pressure responsive switch terminates the supply of electrical power to the compressor motor.

16 Claims, 2 Drawing Sheets

EXPLOSION PROOF COMPRESSOR AND A METHOD FOR EXPLOSION PROOFING A COMPRESSOR

FIELD OF THE INVENTION

The invention relates to a compressor for use with air conditioning or refrigeration systems in a hazardous location where flammable gases or vapors may exist; and a method for explosion proofing such compressors.

DESCRIPTION OF THE PRIOR ART

In many industrial settings, it is necessary to provide air conditioning or refrigeration systems, and because of the existence of flammable gases or vapors at such locations, it is necessary to provide protection against the ignition of such flammable gases or vapors, in order to prevent the occurrence of highly undesired explosions. Examples of such industrial settings include, but are not limited to, oil refineries, offshore hydrocarbon production and/or drilling platforms; and chemical manufacturing and/or refining plants. Such locations are typically designated by the National Fire Protection Association as a Class I, Division I location, which is defined as being normally hazardous due to the presence of flammable gases or vapors which exist under normal operating conditions or may exist frequently because of repair or maintenance operations or because of leakage. Conventional air conditioning or refrigeration systems include a compressor, which may have a compressor crankcase heater associated therewith, both the compressor and the crankcase having conventional electrical supply terminals. Because of the possibility of ignition of the flammable gases or vapors by the electrical supply terminals, it is necessary to explosion proof the compressor when used in a Class I, Division 1 location.

Prior art techniques for explosion proofing compressors for air conditioning or refrigeration systems at Class I, Division 1 locations has been to weld explosion proof fittings over the compressor electrical supply terminals and crankcase heater electrical supply terminals. These prior art fittings are not gas tight, but are made to contain an explosion within the fitting, should flammable gases or vapors enter the fittings and be ignited by the electrical supply terminals. These prior art fittings allow the ignited and burned gases or vapors to escape through closely fitted covers on the fittings, which causes cooling of the gases to a temperature below that which would be necessary to ignite the flammable gases or vapors located outside of the fittings. The disadvantage of utilizing such explosion proof fittings is that in the event of a poor weld joint between the fittings and the compressor housing, the electrical supply terminals being disposed within the fittings, the joint could fail because of the extremely high pressures resulting from an explosion and ignition of the flammable gases or vapors within the fitting. In that instance, it would be likely that the explosion within the fitting and the subsequent failure of the joint would permit such explosion to, in turn, ignite other flammable gases and vapors located outside the fittings. Although it is believed that the weld joint between the fitting and the compressor housing could be hydrostatically tested, such testing is impractical, expensive, not easily performed, and because of such disadvantages is believed not to occur in present practice. Another disadvantage with prior art explosion proof fittings is that they do not prevent the serious problems associated with a highly undesirable explosion, but merely seek to minimize the damage, once an explosion has occurred.

Accordingly, prior to development of the present invention, there has been no explosion proof compressor and method for explosion proofing compressors used in air conditioning and refrigeration systems which is: simple and economical to manufacture; easily assembled, easily tested for quality control associated with the assembly of the compressor; and prevents explosions from occurring, rather than attempting to minimize the damage caused by an explosion. Therefore, the art has sought an explosion proof compressor and method of explosion proofing a compressor for use in air conditioning and refrigeration systems in hazardous locations where flammable gases or vapors may exist, which is: simple and economical to manufacture; easily assembled; easily tested for quality control associated with the assembly of the compressor, and prevents explosions from occurring, which explosions can be caused by the ignition of the flammable gases or vapors by the electrical supply terminals associated with the compressor.

SUMMARY OF THE INVENTION

In accordance with the invention, the foregoing advantages have been achieved by the present compressor for use with air conditioning or refrigeration systems in a hazardous location where flammable gases or vapors may exist. The present invention includes: a compressor housing; a compressor motor located within the compressor housing; a low pressure refrigerant gas inlet line which is associated with the compressor housing; electrical supply terminals associated with the compressor; a first gas tight housing for the electrical supply terminals, the gas tight housing being associated with the compressor housing; supply means for supplying low pressure refrigerant gas into the first gas tight housing; a first pressure responsive control means for controlling electrical power to the compressor motor; a first refrigerant gas pressure line disposed between, and in a fluid-transmitting relationship with, the first gas tight housing and the first pressure responsive control means, whereby upon a pre-selected decrease in pressure in the first gas tight housing, electrical power to the electrical supply terminals is terminated and the flammable gases or vapors are prevented from being ignited by the electrical supply terminals or compressor motor. A further feature of the present invention is that the refrigerant gas may be FREON®.

Another feature of the present invention is that the compressor may include a compressor crankcase heater associated with the compressor housing and having crankcase heater electrical supply terminals; the crankcase heater electrical supply terminals being disposed within a second gas tight housing associated with the compressor housing; a second pressure responsive control means for controlling electrical power to the crankcase heater; and a second refrigerant gas pressure line associated in a fluid-transmitting relationship with the second gas tight housing and the second pressure responsive control means, whereby upon a pre-selected decrease in pressure in the second gas tight housing, electrical power to the crankcase heater electrical supply terminals is terminated and the flammable gases or vapors are prevented from being ignited by the crankcase heater electrical supply terminals or crankcase heater. An additional feature of the present invention is that the first and second pressure responsive control means may be a single pressure responsive switch, and the single pressure responsive switch may be disposed in an explosion proof enclosure.

In accordance with another aspect of the invention, a method for explosion proofing a compressor, for use with air conditioning or refrigeration systems disposed in a hazardous location where flammable gases or vapors may exist is disclosed. The compressor may include a compressor housing, compressor motor, a low pressure refrigerant gas inlet line associated with the compressor housing, and an electrical supply terminal associated with the compressor housing. The method of the present invention comprises the steps of: disposing the electrical supply terminals within a first gas tight housing associated with the compressor housing; supplying low pressure refrigerant gas into the first gas tight housing; utilizing a first pressure responsive control means for controlling the electrical power to the compressor motor; connecting the first gas tight housing to the first pressure responsive control means in a fluid-transmitting relationship by a first refrigerant gas pressure line; and terminating electrical power to the electrical supply terminals upon a pre-selected decrease in pressure in the first gas tight housing, whereby the flammable gases or vapors are prevented from being ignited by the electrical supply terminals or compressor motor.

Another feature of the method of the present invention is that the compressor may include a compressor crankcase heater and crankcase heater electrical supply terminals, further including the steps of: disposing the crankcase heater electrical supply terminals within a second gas tight housing associated with the compressor housing; utilizing a second pressure responsive control means for controlling electrical power to the crankcase heater electrical supply terminals; connecting the second gas tight housing to the second pressure responsive control means in a fluid-transmitting relationship by a second refrigerant gas pressure line; and terminating electrical power to the crankcase electrical supply terminals upon a pre-selected decrease in pressure in the second gas tight housing, whereby the flammable gases or vapors are prevented from being ignited by the crankcase heater electrical supply terminals or crankcase heater.

The explosion proof compressor and method for explosion proofing a compressor for use with air conditioning or refrigeration systems for use in a hazardous location where flammable gases or vapors may exist, when compared with previously proposed prior art compressors and methods for explosion proofing such compressors, have the advantages of: being simple and economical to manufacture and operate; being easily assembled; being capable of being readily tested for quality control associated with the assembly of the compressor; and preventing the ignition of the flammable gases or vapors, and thus preventing explosions.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

Figure 1:
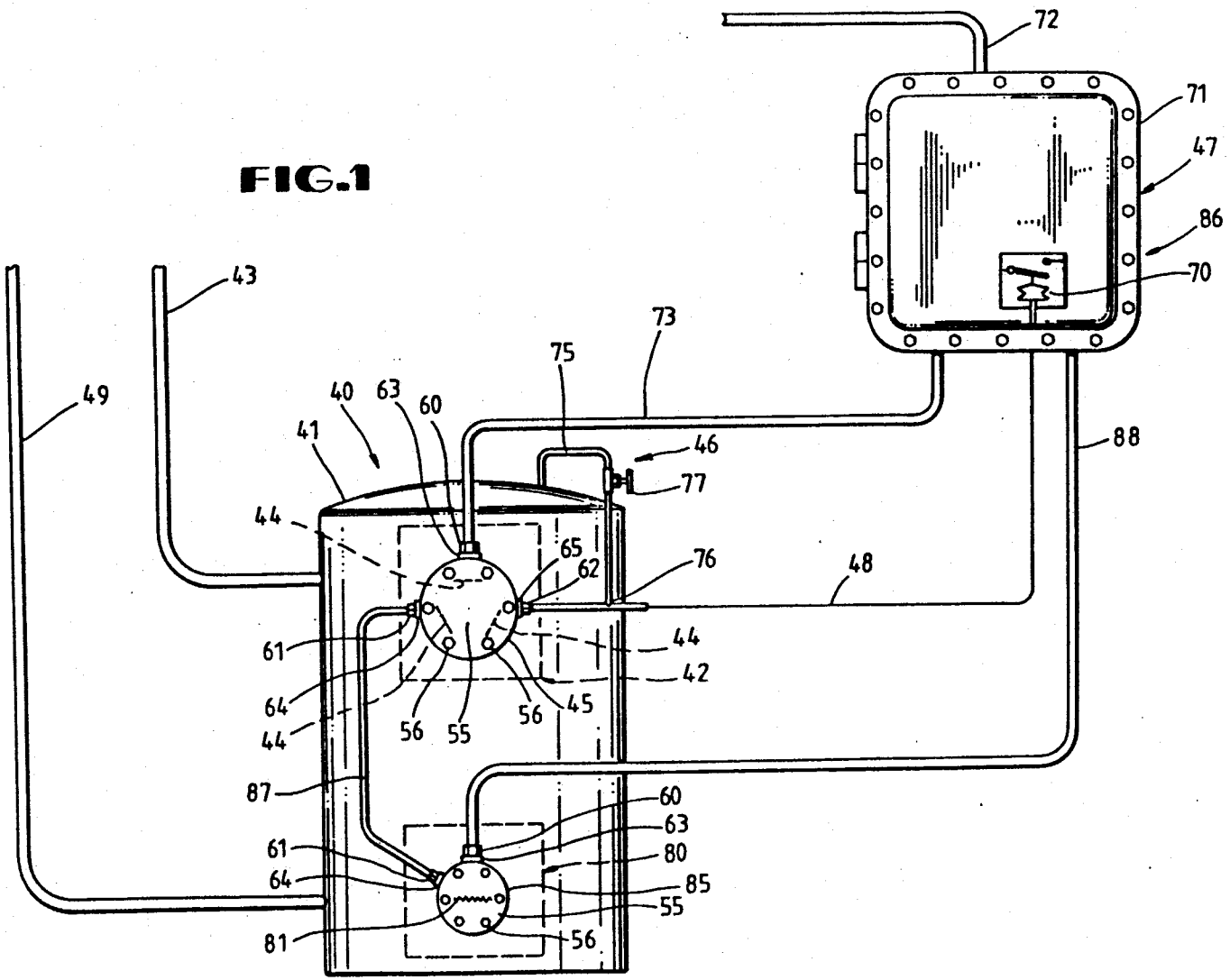
FIG. 1 is a front view of a compressor for use with air conditioning or refrigeration systems in a hazardous location where flammable gases or vapors may exist, in accordance with the present invention.

In FIG. 1, an explosion proof compressor 40 in accordance with the present invention is shown to generally comprise a compressor housing 41; a compressor motor 42 located within the compressor housing 41; a low pressure refrigerant gas inlet line 43, which passes from a conventional air conditioning or a refrigeration system evaporator (not shown) to the compressor 40; conventional electrical supply terminals 44 associated with the compressor housing 41; a first gas tight housing 45 for the electrical supply terminals 44, the gas tight housing 45, being associated with compressor housing 41; supply means 46 for supplying low pressure refrigerant gas into the first gas tight housing 45; a first pressure responsive control means 47 for controlling electrical power to the compressor motor 42; and a first refrigerant gas pressure line 48 disposed between, and in a fluid-transmitting relationship with, the first gas tight housing 45 and the first pressure responsive control means 47. A refrigerant gas discharge line 49 is associated with compressor housing 41, the refrigerant gas discharge line 49 extending from the compressor 40 to a conventional air conditioning or refrigeration condenser (not shown).

Still with reference to FIG. 1, compressor 40 is designed for use with air conditioning or refrigeration systems which are used in a hazardous location where flammable gases or vapors (not shown) may exist, such drilling and/or production offshore platforms. Typically, locations where compressor 40, which is a part of an air conditioning or refrigeration system, is used are defined by the National Fire Protection Association as a Class I, Division 1 location in that such location may have ignitible concentrations of flammable gases or vapors present under normal operating conditions, or where ignitible concentrations of such gases or vapors may exist frequently because of repair or maintenance operations or because of leakage. It is thus desirable to ensure that neither an electrical failure of the compressor motor 42, nor an accidental spark from the electrical supply terminals 44 can cause an explosion of any flammable gases or vapors which may exist and come into contact with the compressor motor 42 or electrical supply terminals 44.

Figure 3:
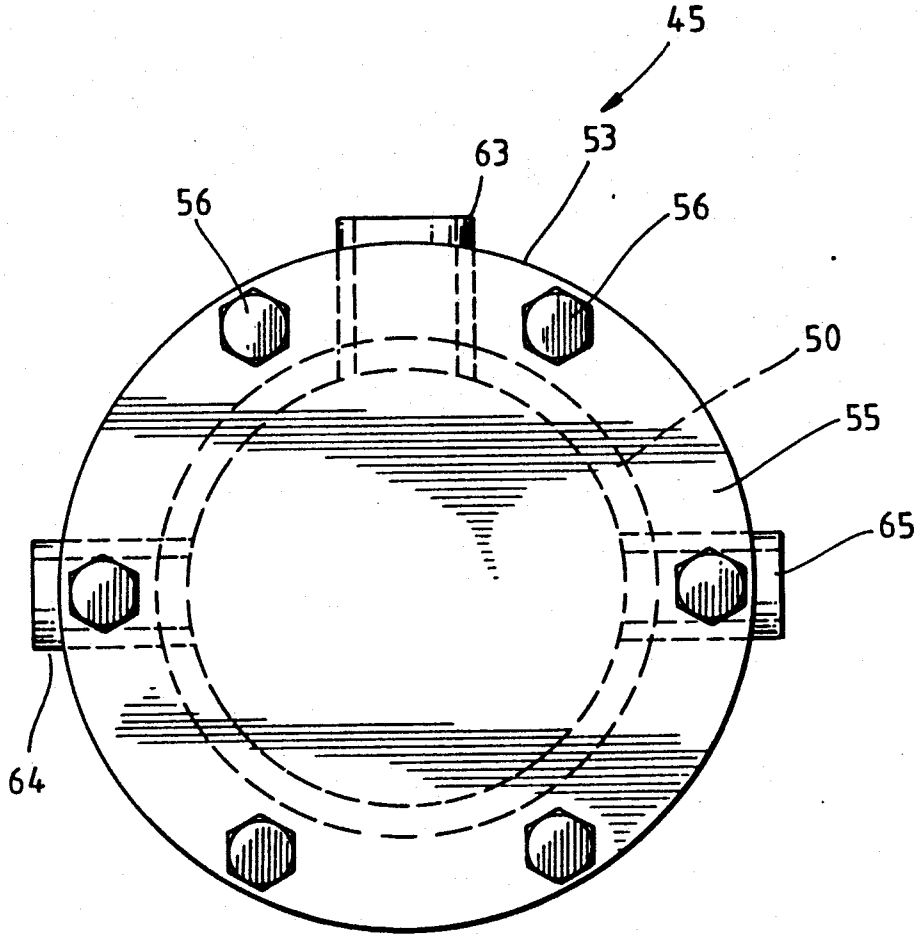
FIG. 3 is a front view of the gas tight housing of FIG. 2, in accordance with the present invention.
Figure 2:
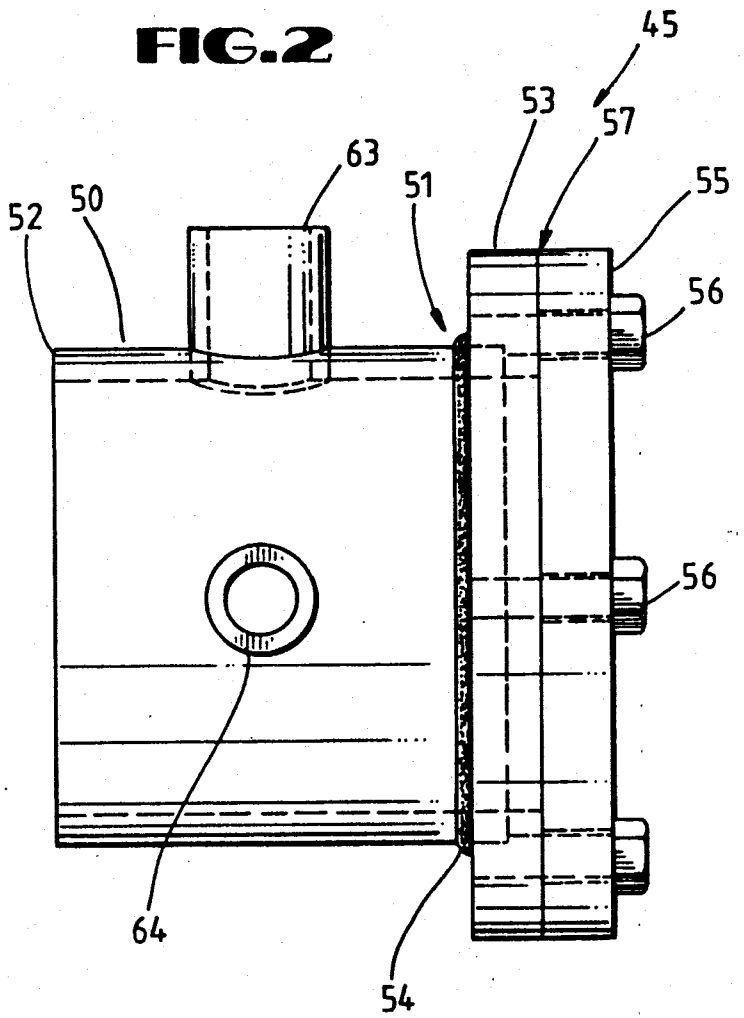
FIG. 2 is a side view of a gas tight housing in accordance with the present invention.

With reference to FIGS. 2 and 3, gas tight housing 45 will be described in greater detail. Gas tight housing 45 may preferably comprise a section of pipe 50 having front and rear ends 51, 52. Pipe 50 is shown to have a circular cross-sectional configuration, which provides a portion of housing 45 for the electrical supply terminals 44; however, pipe section 50 could have any other suitable cross-sectional configuration, such as rectangular, hexagonal, etc. The rear end 52 of pipe section 50 is preferable fixedly secured to compressor housing 41 as by welding. The front end 51 of pipe section 50 has a circular flange member 53 fixedly secured to the front end 51 of pipe section 50 as by a conventional fillet weld 54. A circular cover member 55 is received over flange 53 and secured in place by a plurality of cap screws 56 which are threadedly received within flange member 53. The interface between flange member 53 and cover member 55 is rendered gas tight as by manufacturing interface 57 with a metal-to-metal sealing surface between flange member 53 and cover member 55, or alternatively, a conventional gasket (not shown) may be disposed between flange 53 and cover member 55, in order to provide a gas tight seal when cap screws 56 are tightened upon cover member 55. When gas tight housing 45 is secured to compressor housing 41, as previously described, housing 45 receives the electrical supply terminals 44 within pipe section 50 of housing 45, and any sparks accidentally generated by electrical supply terminals 44 cannot pass outside gas tight housing 45. Additionally, any flammable gases or vapors present outside gas tight housing 45 are precluded from entering housing 45, because of the gas tight seal between flange member 53 and cover member 55, and the welding of the rear end 52 of pipe section 50 to compressor housing 41. As will be hereinafter described in greater detail, another safety precaution which results from the design of compressor 40 also prevents the entry of any flammable gases or vapors into gas tight housing 45. Gas tight housing 45 may also be provided with a plurality of gas tight fittings 60–61 (FIG. 1) which are received within ports, or coupling members, 63–65 provided to pipe section 50, the use of which fittings 60–62 will be hereinafter described in greater detail.

With reference to FIG. 1, first pressure responsive control means 47 preferably is a pressure responsive switch 70, the operation of which will be hereinafter described. Pressure responsive switch 70 may be located at a variety of locations, such as within gas tight housing 45, compressor housing 41, or at a location remote from compressor 40 in a non-hazardous area. Preferably, pressure responsive switch 70 is disposed at a remote location in a fluid-transmitting relationship with gas tight housing 45 via the first refrigerant gas pressure line 48. Preferably, first pressure responsive control means 47, or pressure responsive switch 70, is disposed within a conventional explosion proof electrical enclosure 71. First refrigerant gas pressure line 48 is sealingly received within port 65 of gas tight housing 45 by gas tight fitting 62. Explosion proof electrical enclosure 71 can likewise be provided with similar fittings wherein first explosion proof electrical enclosure 71. received within explosion proof electrical enclosure 71. Electrical power for compressor motor 42 is provided by an electrical supply cable 72 which passes into explosion proof electrical enclosure 71 where a conventional main power contactor may be disposed. As will be hereinafter described in greater detail, first pressure responsive control means 47, or pressure responsive switch 70, controls the transmission of electrical power from electrical power supply cable 72 through the main power contactor (not shown), and to the electrical supply terminals 44 via insulated power cable 73. Cable 73, which extends from the explosion proof electrical enclosure 71 to the gas tight housing 45 is a conventional mineral insulated cable, which is received within gas tight housing 45 as by port 63 and gas tight fitting 60. Similar gas tight fittings may be provided at explosion proof electrical enclosure 71 for cable 73.

Still with reference to FIG. 1, supply means 46 for supplying low pressure refrigerant gas into the first gas tight housing 45 can be either a supply line which is in direct fluid communication with the low pressure refrigerant gas inlet line 43 or with the compressor shell (not shown). The low pressure refrigerant, which is preferably FREON® but can be any other type of non-flammable gaseous and liquid material used as a refrigerant, is then piped by a supply line 75 through a valve 77 and a tee fitting 76 into first refrigerant gas pressure line 48, whereby the low pressure refrigerant gas may flow into housing 45 as well as into fluid-transmitting relationship with the first pressure responsive control means 47, or pressure responsive switch 70. Preferably, the low pressure refrigerant gas is supplied at a pressure of 15 psig. Valve 77 is closed after the desired amount of gas fills housing 45 and line 48.

When the low pressure refrigerant gas is supplied into first gas tight housing 45 at a pressure of approximately 15 psig, this positive pressurization of gas tight housing 45 further serves to prevent the entry of any flammable gases or vapors, which are at atmospheric pressure, from entering gas tight housing 45. So long as the pre-selected pressure value of approximately 15 psig is maintained in the gas tight housing 45, and in turn through first refrigerant gas pressure line 48 to first pressure responsive control means 47, or pressure responsive switch 70, pressure responsive switch 70 is maintained in its normally closed position, whereby the main power contactor is operable to permit the supply of electrical power from power supply line 72 through the main power contactor and cable 73 to electrical supply terminals 44 of compressor 40. Should the pressure in first gas tight housing 45 decrease below the pre-selected value of approximately 15 psig, pressure responsive switch 70 will close, which in turn renders the main power contactor inoperable, whereby electrical power to the electrical supply terminals 44 is terminated. It should be noted that the pre-selected value of 15 psig has been selected because most low pressure refrigerant gas inlet lines for compressors for use with air conditioning or refrigeration system typically provide the refrigerant gas from the evaporator back to the compressor at that pressure. It should be readily apparent to one of ordinary skill in the art that a different pre-selected value for the pressure to be maintained within first gas tight housing 45, as supplied from the supply means 46, which is turn obtains its low pressure refrigerant gas from the low pressure refrigerant gas inlet line 43, could be selected.

It should also be noted that the compressor 40 of the present invention may be readily and easily initially tested by merely running compressor 40 to determine whether or not the first gas tight housing 45, as well as all other gas tight fittings, are in fact gas tight. Should there be any leaks in gas tight housing 45, or related fittings or lines, the low pressure refrigerant gas will leak out causing the pressure to drop below the pre-selected value of 15 psig, whereby pressure responsive switch will assume its closed position and terminate the supply of electrical power to compressor motor 42. This feature is an ongoing safety feature, in that as the compressor 40 continues to operate in normal operation in a hazardous location, the pressure testing of the gas tight housing 45 and its related pressure lines and fittings, is ongoing. Should the pressure within gas tight housing 45, or its related lines and fittings ever develop a leak, the attendant pressure drop will be sensed by the first pressure responsive control means 47, which in turn will terminate all electrical power to compressor 40, and thus prevent the ignition of any flammable gases or vapors which may enter and be present near the electrical supply terminals 44 or compressor motor 42.

It should be further noted that no auxiliary source of any other type of fluid, other then the low pressure refrigerant gas used in compressor 40, is necessary to safely operate compressor 40 in a hazardous location, in that the operation compressor 40 is essentially a "closed system". The safety features provided by the compressor 40 of the present invention are achieved by using the existing low pressure refrigerant gas used in compressor 40. Additionally, no other auxiliary blowers or pumps are necessary to provide the desired positive pressurization of gas tight housing 45. These advantages are particularly desirable when space is at a premium, such as on an offshore platform, or when other sources non-flammable fluids are not really available, or if available require the explosion proofing of any additional pumps or blowers necessary to provide the non-flammable fluid.

In many instances, it is desirable for compressor 40 to have a conventional compressor crankcase heater associated with compressor housing 41. Crankcase heater 80 would include crankcase heater electrical supply terminals 81. In accordance with the present invention, a second gas tight housing 85 is associated with compressor housing 41, the crankcase heater electrical supply terminals 81 being disposed within the second gas tight housing 85. The construction of second gas tight housing 85 is substantially identical to the construction of first gas tight housing 45, and the same reference numerals are used for identical, or substantially identical parts thereof.

Still with reference to FIG. 1, a second pressure responsive control means 86 may be provided for controlling electrical power to the crankcase heater 80. A second refrigerant gas pressure line 87 is associated in a fluid-transmitting relationship with the second gas tight housing 85 and a second pressure responsive control means 86, whereby upon a pre-selected decrease in pressure in the second gas tight housing 85, electrical power to the crankcase heater electrical supply terminals 81 is terminated and the flammable gases or vapors are prevented from being ignited by the crankcase heater electrical supply terminals 81 or crankcase heater 80. The second refrigerant gas pressure line 87 may extend from second gas tight housing 85 directly to the second pressure responsive control means 86, which can be disposed within explosion proof electrical enclosure 71 as previously described in connection with first pressure responsive means 47. Rather than have a separate refrigerant gas pressure line extending from the second gas tight housing 85 to the second pressure responsive control means 86, it is preferred that the second refrigerant gas pressure line be disposed in a fluid-transmitting relationship between the first and second gas tight housings 45, 85, shown in FIG. 1. The second refrigerant gas pressure line is provided will suitable gas tight fittings 61 which are received within ports 64 in the first and second gas tight housings 45, 85. Preferably, first and second pressure responsive control means 47, 86, is the single pressure responsive switch 70 previously described, in that both first and second gas tight housings 45, 85, are in a fluid-transmitting relationship with pressure responsive switch 70 via the first and second refrigerant gas pressure lines 48, 87. Another insulated power cable 88 passes between the second gas tight housing 85 and the explosion proof electrical enclosure 71, whereby electrical power from the main power supply cable 72 can pass through the main power contactor, insulated power cable 88, and to the electrical supply terminals 81 for crankcase heater 80. Insulated power cable 73 is received within port 63 of second gas tight housing 85 by a gas tight fitting 60, as previously described.

Thus, upon the pressure within the first or second gas tight housings 45, 85, or any refrigerant gas pressure lines 48, 87, 75, decreasing below the pre-selected pressure value, pressure responsive switch 70 closes, thus terminating the transmission of electrical power to both the electrical supply terminals 44, 81, of compressor 40 and crankcase heater 80, and any flammable gases or vapors which are present outside compressor 40 are prevented from being ignited.

It is to be understood that the invention is not limited to the exact details of construction, operation, exact materials or embodiment shown and described, as obvious modifications and equivalents will be apparent to ones skilled in the art; for example, a single gas tight housing may be provided which contains both the electrical supply contacts for the compressor motor and the crankcase heater. Accordingly, the invention is therefore to be limited only by the scope of the appended claims.

I claim:

1. A compressor for use with air conditioning or refrigeration systems in a hazardous location where flammable gases or vapors may exist, comprising:

a compressor housing;

a compressor motor located within the compressor housing;

a low pressure refrigerant gas inlet line associated with the compressor housing;

electrical supply terminals associated with the compressor housing;

a first gas tight housing for the electrical supply terminals, the first gas tight housing being associated with the compressor housing;

supply means for supplying low pressure refrigerant gas into the first gas tight housing;

a first pressure responsive control means for controlling electrical power to the compressor motor;

a first refrigerant gas pressure line disposed between, and in a fluid-transmitting relationship with, the first gas tight housing and the first pressure responsive control means, whereby upon a pre-selected decrease in pressure in the first gas tight housing, electrical power to the electrical supply terminals is terminated and the flammable gases or vapors are prevented from being ignited by the electrical supply terminals or compressor motor.

2. The compressor of claim 1, wherein the refrigerant gas is FREON.

3. The compressor of claim 1, wherein the first pressure responsive control means is disposed in an explosion proof enclosure.

4. The compressor of claim 3, wherein an insulated power cable is disposed between the first gas tight housing and the explosion proof enclosure.

5. The compressor of claim 1, further including: a compressor crankcase heater associated with the compressor housing and having crankcase heater electrical supply terminals, the crankcase heater electrical supply terminals being disposed within a second gas tight housing associated with the compressor housing; a second pressure responsive control means for controlling electrical power to the crankcase heater; and a second refrigerant gas pressure line associated in a fluid-transmitting relationship with the second gas tight housing and the second pressure responsive control means, whereby upon a pre-selected decrease in pressure in the second gas tight housing, electrical power to the crankcase heater electrical supply terminals is terminated and the flammable gases or vapors are prevented from being ignited by the crankcase heater electrical supply terminals or crankcase heater.

6. The compressor of claim 5, wherein the first and second pressure responsive control means is a single pressure responsive switch.

7. The compressor of claim 6, wherein the single pressure responsive switch is disposed in an explosion proof enclosure.

8. The compressor of claim 6, wherein the second refrigerant gas pressure line is disposed in a fluid-transmitting relationship between the first and second gas housings.

9. A method for explosion proofing a compressor, for use with air conditioning or refrigeration systems, disposed in a hazardous location where flammable gases or vapors may exist, the compressor including a compressor housing, compressor motor, a low pressure refrigerant gas inlet line associated with the compressor housing and electrical supply terminals associated with the compressor housing, comprising the steps of:

disposing the electrical supply terminals within a first gas tight housing associated with the compressor housing;

supplying low pressure refrigerant gas into the first gas tight housing;

utilizing a first pressure responsive control means for controlling electrical power to the compressor motor;

connecting the first gas tight housing to the first pressure responsive control means in a fluid-transmitting relationship by a first refrigerant gas pressure line; and terminating electrical power to the electrical supply terminals upon a pre-selected decrease in pressure in the first gas tight housing, whereby the flammable gases or vapors are prevented from being ignited by the electrical supply terminals or compressor motor.

10. The method of claim 9, including the step of utilizing a hydrocarbon based refrigerant as the refrigerant gas.

11. The method of claim 9, including the step of disposing the first pressure responsive control means in an explosion proof enclosure.

12. The method of claim 11, including the step of disposing an insulated power cable between the first gas tight housing and the explosion proof enclosure.

13. The method of claim 9, wherein the compressor includes a compressor crankcase heater and crankcase heater electrical supply terminals, further including the steps of:

disposing the crankcase heater electrical supply terminals within a second gas tight housing associated with the compressor housing;

utilizing a second pressure responsive control means for controlling electrical power to the crankcase heater electrical supply terminals;

connecting the second gas tight housing to the second pressure responsive control means in a fluid-transmitting relationship by a second refrigerant gas pressure line; and terminating electrical power to the crankcase electrical supply terminals upon a pre-selected decrease in pressure in the second gas tight housing, whereby the flammable gases or vapors are prevented from being ignited by the crankcase heater electrical supply terminals or crankcase heater.

14. The method of claim 13, including the step of utilizing a single pressure responsive switch as the first and second pressure responsive control means.

15. The method of claim 14, including the step of disposing the single pressure responsive switch in an explosion proof enclosure.

16. The method of claim 13, including the step of disposing the second refrigerant gas pressure line in a fluid-transmitting relationship between the first and second gas tight housings.

* * * * *

UNITED STATES PATENT AND TRADEMARK OFFICE

CERTIFICATE OF CORRECTION

PATENT NO. : 5,192,194

DATED : March 9, 1993

INVENTOR(S) : Gaylon W. Birdwell

It is certified that error appears in the above-identified patent and that said Letters Patent is hereby corrected as shown below:

Column 8,

In claim 2, line 2, delete "FREON", and insert -- a hydrocarbon based refrigerant --.

Signed and Sealed this

Thirtieth Day of November, 1993

Bruce Lehman

*Attest:*

BRUCE LEHMAN

*Attesting Officer*

*Commissioner of Patents and Trademarks*